United States Patent [19]

Arai et al.

[11] Patent Number: 4,809,650

[45] Date of Patent: Mar. 7, 1989

[54] VARIABLE COMPRESSION CONTROL ARRANGEMENT FOR INTERNAL COMBUSTION ENGINE

[75] Inventors: Takayuki Arai, Yokosuka; Hiromichi Ofuji; Takaharu Goto, both of Yokohama; Takehisa Kondo, Kanagawa; Seinosuke Hara; Seiji Suga, both of Atsugi; Hiroaki Hamada; Tatsuyuki Matsuya, both of Atsugi, all of Japan

[73] Assignees: Nissan Motor Co., Ltd.; Atsugi Motor Parts Co., Ltd., both of Japan

[21] Appl. No.: 104,910

[22] Filed: Oct. 6, 1987

[30] Foreign Application Priority Data

Oct. 9, 1986 [JP] Japan ..... 61-240804
Jan. 27, 1987 [JP] Japan ..... 62-16854
May 29, 1987 [JP] Japan ..... 62-84315[U]

[51] Int. Cl.[4] ..... F02B 75/04; F02D 15/02
[52] U.S. Cl. ..... 123/78 B; 123/48 B
[58] Field of Search ..... 123/48 R, 48 B, 78 R, 123/78 B, 193 P; 92/80, 82, 216, 255

[56] References Cited

U.S. PATENT DOCUMENTS 3,450,112 6/1969 Bachle ..... 123/78 B
3,704,695 12/1972 Cronstedt ..... 123/78 B
4,342,291 8/1982 Lewis ..... 123/78 B
4,469,055 9/1984 Caswell ..... 123/78 B

FOREIGN PATENT DOCUMENTS 3416346 11/1985 Fed. Rep. of Germany .... 123/78 B
0025637 5/1983 Japan .

*Primary Examiner*—Willis R. Wolfe
*Attorney, Agent, or Firm*—Lowe, Price, Leblanc, Becker & Shur

[57] ABSTRACT

To induce high compression engine operation hydraulic fluid is fed into a variable volume chamber defined between an outer piston and an inner one which is reciprocatively disposed therein via a supply passage which includes a one-way valve. When low compression engine operation is required the pressure supplied to a valve chamber in which a spool valve is disposed is increased to the point whereat the spool valve moves to a position wherein the supply passage is closed and a drain and transfer passages are opened. The drain passage leads directly to the cylinder bore so as to enable the hydraulic fluid in the variable volume chamber to be vented unrestrictedly. The transfer passage permits a small amount of hydraulic fluid to flow through the variable volume chamber to the drain passage in a manner which cools the same and prevents degradation of the hydraulic fluid retained in the one-way valve and the like.

11 Claims, 10 Drawing Sheets

VARIABLE COMPRESSION CONTROL ARRANGEMENT FOR INTERNAL COMBUSTION ENGINE

BACKGROUND OF THE INVENTION

1. Field of the Invention

The present invention relates to an internal combustion engine and more specifically to an arrangement which permits the compression ratio of the engine to be selectively controlled.

2. Description of the Prior Art

FIG. 1 shows a prior art arrangement disclosed in Japanese Utility Model Pre-Publication No. 58-25637. This arrangement includes an outer piston 10, an inner piston 12 reciprocatively received within the outer one in a manner to define a first variable volume chamber 14, a piston pin 16 which extends through the inner and outer pistons 10, 12, and a con-rod 18 which operatively interconnects the piston pin 16 with a crankshaft of the engine (not shown). An annular retainer 20 is threadedly received in the lower portion of the outer piston 10. This member is formed with a horizontally extending flange portion 21 which cooperates with a step formed in the bottom of the inner piston 12 to define an annular shaped variable volume chamber 22.

A source of hydraulic fluid under pressure generally denoted by the numeral 24 includes a sump or oil pan 26, a pump 28 which inducts oil from the pan, and a control circuit 30 which is responsive to a plurality of sensors 32 and which controls the operation of the pump 28. In the above mentioned document the sensors 32 are disclosed as being ones which sense the driving condition parameters.

The output of the pump 28 is supplied to the first variable volume chamber 14 via a first passage 34 which is bored or similarly formed in the con-rod 18, a second passage arrangement 36 formed in the piston pin 16 and a third passage 38 which extends through the inner piston 12 to the first variable volume chamber 14. A one-way valve 40 is disposed at the downstream end of the third passage 38 and arranged to prevent the back flow of hydraulic fluid which passes therethrough.

A control valve arrangement is disposed in a bore formed in the inner piston 12. This valve (as shown in FIG. 2) includes a spool 42 which is biased in one direction by a spring 44. This valve is arranged to be responsive to the pressure prevailing in the first, second and third passages 34, 36, 38 in a manner to control the amount of hydraulic fluid which is permitted to drain from the first variable volume chamber 14 via a fourth passage 46 which extends through the inner piston 14. The downstream end of a drain passage 48 which leads from the bore in which the spool 42 is disposed, is arranged to open into the inner periphery of the inner piston 12 as shown, to permit the hydraulic fluid to precipitate down toward the engine crankshaft and the oil pan 26 of the engine. A one-way valve 50 is disposed in the upstream end of the fourth passage 46 and arranged to prevent the return of any fluid which has flow out of the first variable volume chamber 14 into the fourth passage.

When the pressure discharge by the pump 28 increases, the spool 42 of the control valve is biased against the spring 44 in a manner which tends to prevent the flow of hydraulic fluid through the fourth passage 46 and thus ensure that the pressure in the first variable volume chamber 14 reaches that prevailing in the first, second and third passages 34, 36, 38. As will be appreciated, as the pressure in the first variable volume chamber 14 increases the outer piston 10 is biased to rise up away from the inner one 12 and in a direction which increases the compression ratio of the engine.

On the other hand, when the pressure discharge of the pump 28 lowers, the spool 42 of the control valve tends to move to the left as seen in the drawings and thus tend to open the fourth passage 46 in a manner which permits the hydraulic fluid which has been supplied into the first variable volume chamber 14 to be drained into the second annular variable volume chamber 22.

By controlling the level of the pressure discharged by the pump 28, the degree by which the outer piston 10 is displaced from the inner one can be controlled and thus permit the compression ratio of the engine to be controlled.

This form of compression control is highly advantageous in that, at low engine speeds a higher compression provides good engine response and acceleration while at higher engine speeds a lower compression ratio permit the engine speed to be increased without the fear of engine knock and/or in the worst case severe engine damage. The particular type of control also lends itself advantageously to use in Diesel engines which inherently have a high compression ratio. With Diesel engines the high compression ratio leads, under certain modes of engine operation, to the situation wherein the friction loss causes a power output reduction.

However, the arrangement disclosed above has suffered from a number of drawbacks which tends to inhibit practical application.

The first of these comes in that, during low compression operation wherein the first or upper variable volume chamber 14 is drained and the engine is operating at high speeds and a large amount of fuel is being combusted, the heat generated by the combustion causes the oil retained in the upper section of the third passage 38 in which the one-way valve 40 is disposed, to undergo degradation after prolonged exposure, and induce the formation of gummy tar residues and deposits which inhibit proper operation.

A second drawback comes in that a special pump must be provided. Viz., the output of the normal engine oil pump cannot be used as the output thereof is low at low engine speeds and cannot provide the required pressure level.

A yet further drawback occurs when it is required to reduce the compression ratio toward a lower value and it is necessary to drain the first variable volume chamber 14. During this operation the oil from the first variable volume chamber 14 is transferred to the second annular one 22 via the fourth passage 46. However, the cross-sectional area and volume of the second variable volume chamber 22 is less than the first 14. Thus, as the amount of fluid which must be transferred is greater than can be received in the lower chamber 22. During this mode the provision of seal elements 52, 54 on the inner piston 12 prevents leakage from the lower chamber 22. Accordingly the problem that the hydraulic fluid cannot be readily removed from the upper chamber 12 occurs. This tends to deteriorate the high to low compression transition response characteristics of the device.

SUMMARY OF THE INVENTION

It is an object of the present invention to provide an arrangement which enables the compression of an internal combustion engine can be selectively varied with good response to the demand therefor and which also simultaneously prevents the formation of gummy tar deposits within the operating chambers of the device.

In brief, the above object is achieved by an arrangement wherein, in order to induce high compression engine operation, hydraulic fluid is fed into a variable volume chamber defined between an outer piston and an inner one reciprocatively disposed therein, via a supply passage which includes a one-way valve. When low compression engine operation is required the pressure supplied to a valve chamber in which a spool valve is disposed is increased to the point whereat the spool valve moves to a position wherein the supply passage is closed and a drain and transfer passages are opened. The drain passage leads directly to the cylinder bore so as to enable the hydraulic fluid in the variable volume chamber to be vented unrestrictedly thereinto. The transfer passage permits a small amount of hydraulic fluid to enter the variable volume chamber and subsequently exhaust through the drain passage in a manner which cools the same and prevents degradation of the hydraulic fluid retained in the oneway valve and the like.

More specifically, the present invention comes in the form of an internal combustion engine having a cylinder and which features a compression ratio control arrangement which comprises: a first piston reciprocatively disposed in said cylinder, said first piston having an axial blind bore formed therein; a second piston reciprocatively disposed in said axial blind bore to define a first variable volume chamber therein; a retainer for retaining said second piston in said axial blind bore and defining a second annular variable volume chamber between it and said second piston; a piston pin which operatively interconnects a connecting rod with said second piston; a source of hydraulic fluid under pressure; a valve chamber in constant communication with said source; a supply passage formed in said second piston, said supply passage leading from said valve chamber to said first variable volume chamber; a drain passage formed in said second piston, said drain passage leading from said first variable volume chamber to a port through which hydraulic fluid can directly drain into said cylinder; a transfer passage formed in said second piston, said transfer passage leading from said valve chamber to said first variable volume chamber, said transfer passage having a cross section which is smaller than that of said drain passage; a valve element disposed in said valve chamber, said valve element being responsive to the pressure prevailing in said valve chamber and arranged so that when the pressure in said valve chamber is below a predetermined value, it assumes a first position wherein communication between said chamber and said drain and transfer passages is cut off and communication between said valve chamber and said supply passage is established, and when the pressure in said valve chamber is above said predetermined value it assumes a second position wherein communication between said valve chamber and said supply passage is cut-off and communication between said drain and transfer passages is established.

DETAILED DESCRIPTION OF THE PREFERRED EMBODIMENTS

Figure 1:
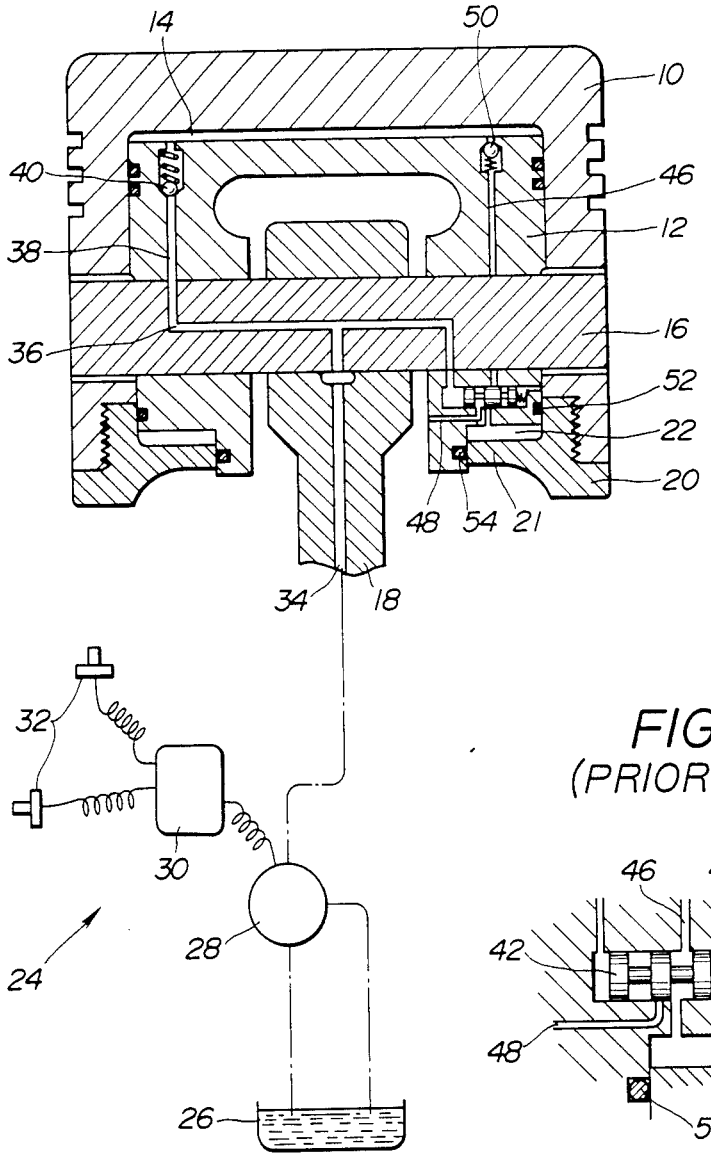
FIG. 1 (PRIOR ART)
FIG. 1 is a front sectional elevation of the prior art arrangement discussed in the opening paragraphs of the instant disclosure.
Figure 2:
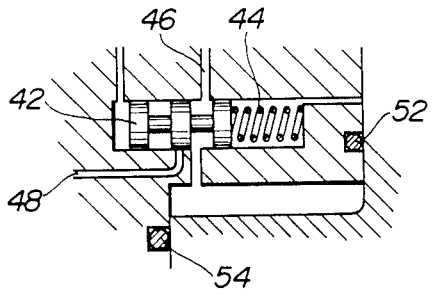
FIG. 2 (PRIOR ART)
FIG. 2 is a enlarged view of the control valve which is used in the arrangement depicted in FIG. 1.
Figure 3:
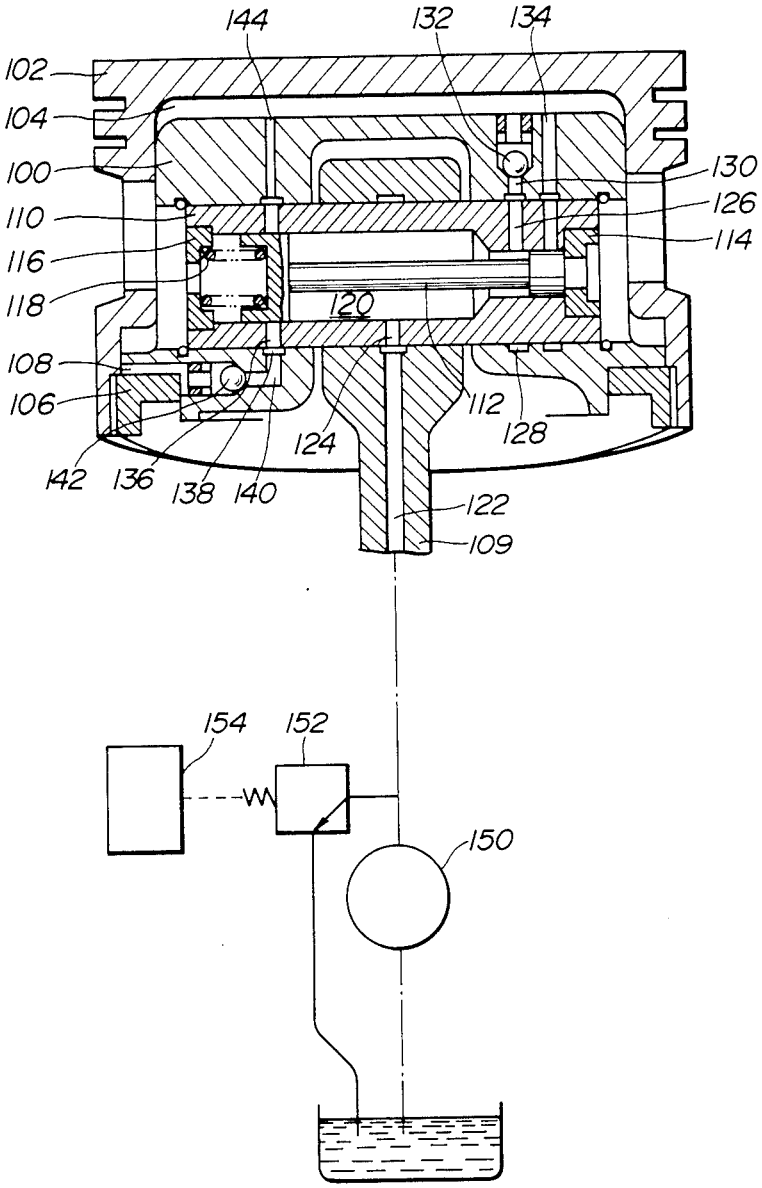
FIG. 3 is a front sectional elevation showing a first embodiment of the present invention conditioned for high compression ratio operation.
Figure 4:
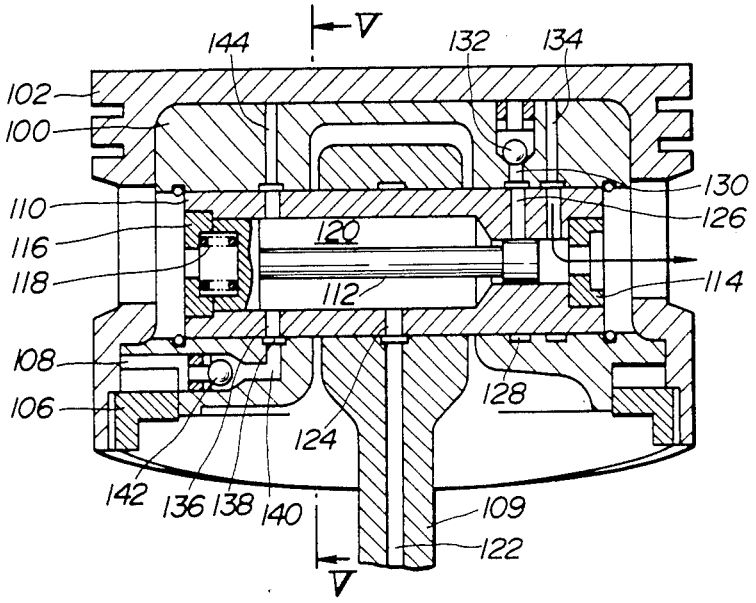
FIG. 4 is a front sectional elevation similar to that of FIG. 3 showing the first embodiment conditioned for low compression ratio operation.
Figure 5:
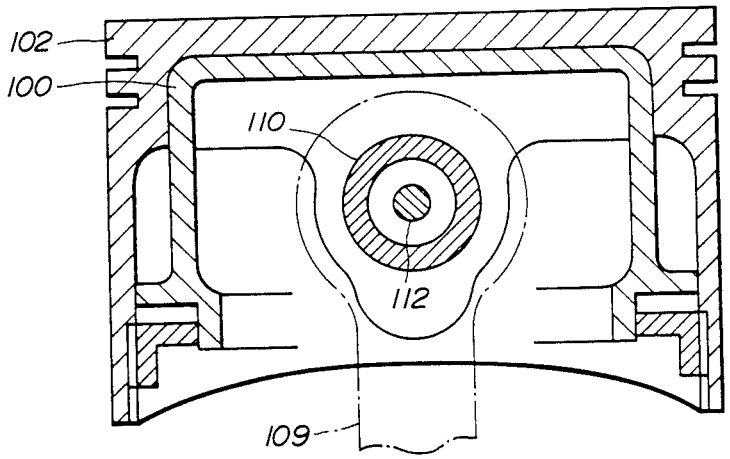
FIG. 5 is a side sectional view taken along section lines V—V of FIG. 4.

FIGS. 3 to 5 show a first embodiment of the present invention. In this arrangement an inner piston 100 is reciprocatively received in a blind bore formed in an outer piston 102 in a manner to define a first variable volume chamber 104 therein. An annular retainer 106 is disposed in the lower portion of the outer piston 102 in a manner to limit the amount of movement of the inner piston 100 within the outer one and simultaneously cooperate with a step formed in the inner piston 100 to define a second annular variable volume chamber 108. The interface defined between the inner piston 100 and the retainer 106 is such as to be non-hermetic and permit a certain amount of leakage when the chamber 108 is pressurized. The reason for this will become more apparent hereinlater.

A con-rod (connecting rod) 109 is connected to the inner piston 100 by a piston 110 which in this embodiment is formed with a stepped bore in which a spool valve element 112 is disposed. The spool valve elements includes a large diameter land and a small diameter land interconnected by a shaft section. The piston pin 110 is retained in placed in a through bore formed in the inner piston 100 by way of snap rings. As shown, the length of the piston pin is less than the diameter of the inner piston 100.

Annular stopper membranes 114, 116 are disposed in the ends of the stepped bore in a manner to retain the spool valve element 112 therein. A spring 118 is disposed between the large diameter land of the spool valve element 112 and the stopper member 116 and arranged to bias the spool valve element 112 toward the position illustrated in FIG. 3.

An essentially cylindrical valve chamber 120 defined in the stepped bore between the lands of the spool valve element 112 communicates with a source of hydraulic fluid under pressure by way of a first passage 122 formed through the con-rod 109 and a radial bore 124 formed in the piston pin 110.

A supply passage structure via which the cylindrical chamber 120 is fluidly communicated with the first variable volume chamber 104 includes a radial bore 126 formed in the piston pin 110, a groove 128 formed in the inner periphery of the through bore formed in the inner piston in which the piston pin 110 is received, and a bore 130 which leads from the groove 128 to the crown of the inner piston 100. The latter mentioned bore 130 is drilled out and a one-way ball valve 132 disposed therein. This valve 132 prevents the flow of hydraulic fluid from the first variable volume chamber 104 back through the first passage structure.

A drain passage structure which communicates the first variable volume chamber 104 with the stepped bore in which the spool valve element 112 is disposed, is formed in manner which is essentially the same as supply passage structure. Accordingly, this structure is denoted by the single numeral 134 for simplicity.

The second annular variable volume chamber 106 communicates with the cylindrical valve chamber 120 via a communication passage structure which includes a radial bore 136, a channel 138 formed in the inner periphery of the through diametrically extending bore of the inner piston 100, and an elblow shaped bore 140 which leads from the groove 138 to the second annular variable volume chamber 108. A second one-way valve 142 is disposed in the elbow shaped bore 140 and arranged to prevent the reverse flow of hydraulic fluid out of the chamber 108.

A transfer passage 144 which takes the form of a bore having a diameter which is smaller than those of the supply and drain passage structures mentioned hereinabove, is arranged to lead from the groove 138 of the communication passage structure to the crown of the inner piston 100.

When the hydraulic pressure prevailing in the cylindrical chamber 120 is less than that which overcomes the bias of the spring 118, the spool valve element 112 assumes the position illustrated in FIG. 3. In this position the lands of the spool valve element 112 close the radial bores assocated with the drain, communication and transfer passage structures and permit only the supply passage structure to communicate with the cylindrical valve chamber 120. However, upon the pressure in the chamber 120 increasing beyond that which can be resisted by the spring 118 the spool valve element 112 moves the position illustrated in FIG. 4. In this position the communication and transfer structures are placed in communication with the cylindrical valve chamber 120, the supply passage isolated therefrom and the drain passage 134 opened in a manner which permits the hydraulic fluid in the first variable volume chamber 104 to drain out through the end of the piston pin 110 as shown by the arrow in FIG. 4.

The supply of hydraulic fluid under pressure in this instance takes the form of a pump 150 which advantageously can be the engine oil pump, a pressure control valve 152 and a control circuit 154. The control circuit is responsive to engine and/or vehicle operational parameters such as engine speed, engine load, engine knock, engine temperature, and the like.

The control circuit 154 is arranged to condition the pressure control valve 152 so that when high compression operation is required, the valve 152 permits some of the supplied pressure to be relieved and thus holds the pressure supplied into the cylindrical valve chamber 120 at or below a predetermined level. On the other hand, when low compression operation is required, the valve 152 is conditioned to reduce the amount of pressure which is relieved and induce the pressure in the cylindrical valve chamber 120 to increase above the predetermined level to one at which the spool valve element 112 is moved to the position shown in FIG. 4.

In operation when high compression operation is required and the pressure in the cylindrical valve chamber 120 is held below that required to move the spool valve element 112 against the spring 118, hydraulic fluid flows through the supply passage structure into the first variable volume chamber 104. As this passage is not resticted by a spring baised valve member such as used in the prior art, the load on the pump is reduced. Under these conditions the first variable volume chamber 104 quickly fills and the outer piston 102 rises to the point where the annular retainer 106 abuts the bottom of the inner piston 100 and prevents any further movement. During the compression and expansion strokes the one-way valve 132 prevents the hydraulic fluid in the first variable volume chamber 104 from being displaced undesirably.

When low compression operation is required the control circuit 154 induces the pressure control valve 152 to boost the level of pressure prevailing in the cylindrical valve chamber 120 and induce the spool valve element 112 to slide to the position wherein the drain passage is opened. Simultaneously, as the hydraulic fluid in the first variable volume chamber 104 is permitted to exhaust out through the end of the piston pin 110 hydraulic fluid under pressure is supplied into the second annular variable volume chamber 106. The pressurization of the second chamber 106 generates a bias which tends to drive the outer piston 102 down into abutment with the inner one 100 and thus assume the relationship shown in FIG. 4.

Under these conditions hydraulic fluid is also supplied into the transfer conduit 144 from the cylindrical valve chamber 120. During the downstroke of the piston during the induction phase, for example, a slight clearance tends to develop between the crown of the inner piston 100 and the inner surface of the outer one 102 and permits a small amount of hydraulic fluid to enter the first variable volume chamber 104. Subsequently, during the compression and expansion phases of the engine, the small amount of hydraulic fluid which is in the first variable volume chamber 104 tends to be squeezed out through the drain passage arrangement. The cyclic repetition of this induces a small flow of hydraulic fluid through the first variable volume chamber 104 which acts as a coolant and cools the first variable volume chamber 106 same to the point where degradation of the oil and the subsequent formation of gummy tar deposits and the like is prevented.

When it is desired to re-establish high compression operation and the spool valve element 112 is permitted to return the position shown in FIG. 3 in response to the reduction of the pressure in the cylindrical chamber 104, as the volume of hydraulic fluid in the first variable volume chamber 104 increases the hydraulic fluid in the second chamber 106 is permitted to leak out through the interface between the inner piston 100 and the annular retainer 106. This leakage damps the ascent of the outer piston 102 with respect to the inner one and smooths the change over without hindering the same.

Figure 6:
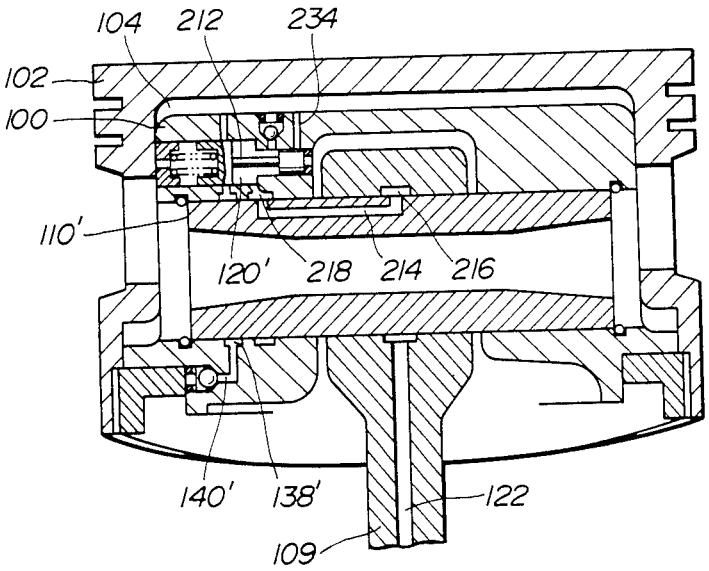
FIG. 6 is a front sectional elevation of showing a second embodiment of the present invention.

FIG. 6 shows a second embodiment of the present invention. In this arrangement the spool valve element 212 is disposed in a stepped bore (no numeral) formed in the inner piston 100 rather than in the piston pin. Other than this the construction and operation is basically similar to that of the first embodiment. Viz., supply, drain and transfer passages (no numerals) lead from a small essentially cylindrical valve chamber 120' to the first variable volume chamber 104.

In this arrangement the drain passage 234 is arranged to open into the well-like section of the inner piston 100 into which the upper section of the con-rod extends.

An elbow shaped connection passage 140' interconnects the second annular variable volume chamber with a groove 138' formed in the bore in which the piston pin 110' is disposed. As will be noted piston pin 110$\propto$ is hollow and provided with a passage 214 which interconnects a groove 216 and a port 218 which opens into the valve chamber 120'. The passage 122 formed in the con-rod 109 also communicates with groove 216.

Figure 7:
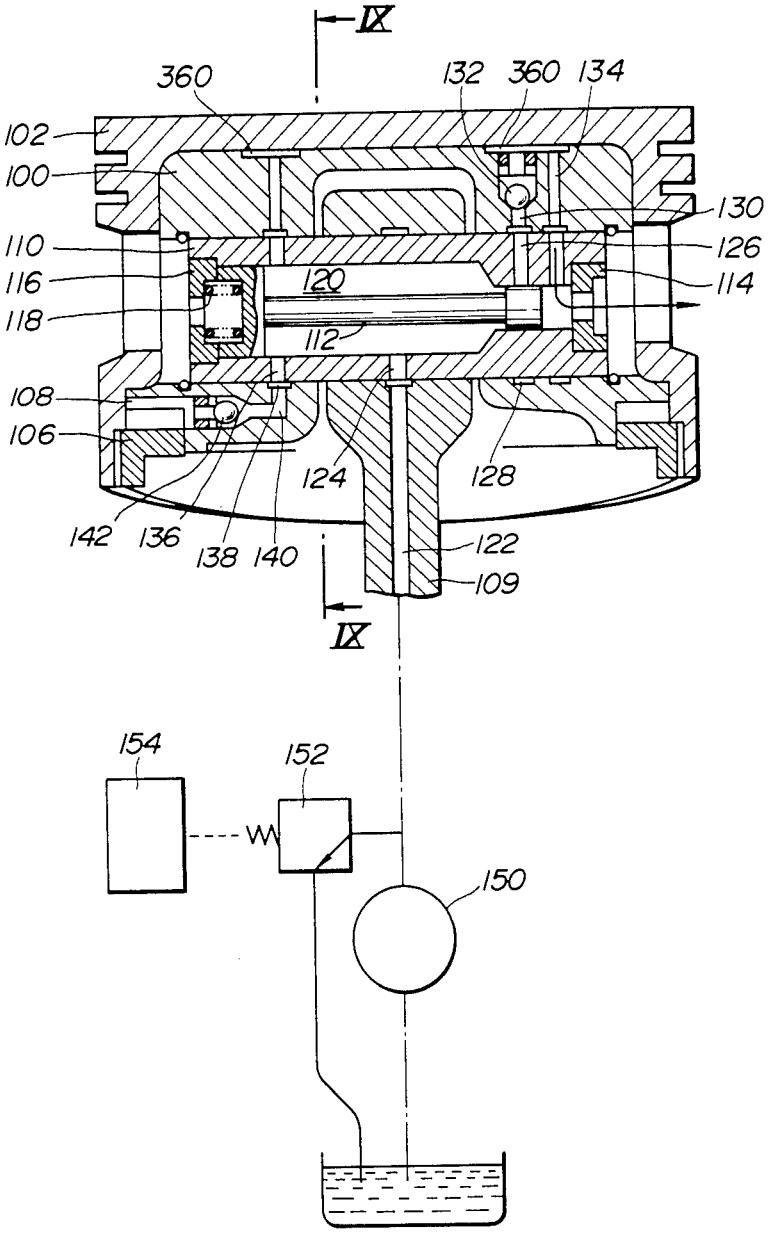
FIG. 7 is a front sectional elevation showing a third embodiment of the present invention conditioned for low compression ratio operation.
Figure 8:
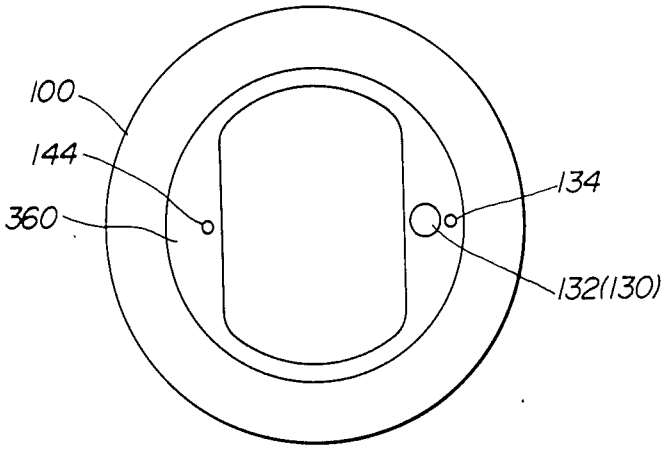
FIG. 8 is a top plan view of crown of the inner piston used in the third embodiment.
Figure 9:
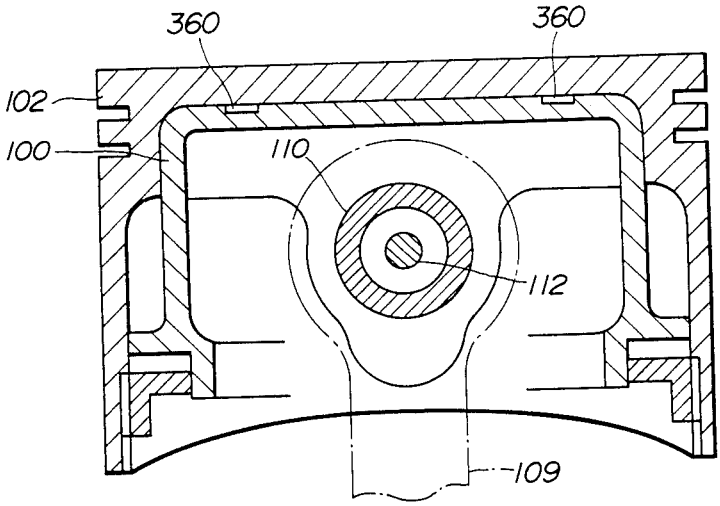
FIG. 9 is a side sectional elevation as taken along section lines IX—IX of FIG. 7.
Figure 10:
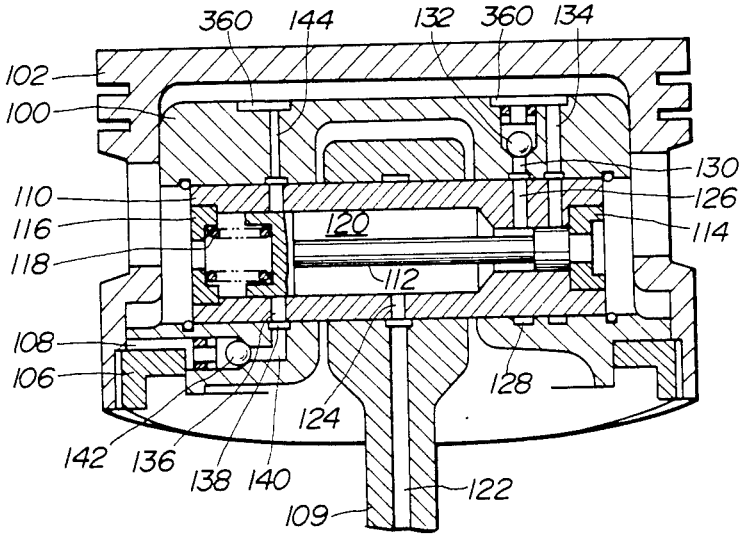
FIG. 10 is a front sectional elevation showing a third embodiment conditioned for high compression ratio operation.

FIG. 7 shows a third embodiment of the present invention. This embodiment is basically the same as the first one and differs only in that an essentially annular recess 360 is formed in the crown of the inner piston 100. The shape of the recess 360 is shown in FIG. 8. As is also shown in this figure, all of the transfer, supply and drain passage structures communicate with the recess.

The provision the recess 360 serves to permit a finite amount of hydraulic fluid to be retained in the first variable volume chamber 104 even when the inner and outer pistons 100, 102 assume the relationship illustrated in FIG. 7 and improve the flow characteristics of the hydraulic fluid through the first variable volume chamber by permitting a more ready flow during low compression operation. Viz., the recess functions to positively guide the small amount of hydraulic fluid which is introduced into the first variable volume chamber under such modes of operation, along a predetermined path which ensures that the fluid which is retained in the section of the supply passage in which the one-way valve is disposed, is kept at a suitably low temperature and thus not subject to heat induced degradation.

Figure 11:
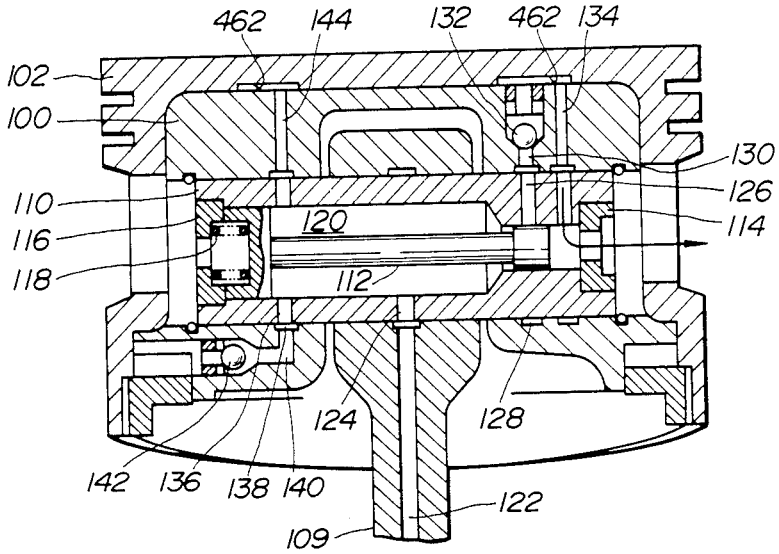
FIGS. 11 and 12 are front sectional elevations showing fourth and fifth embodiments of the present invention, respectively.
Figure 12:
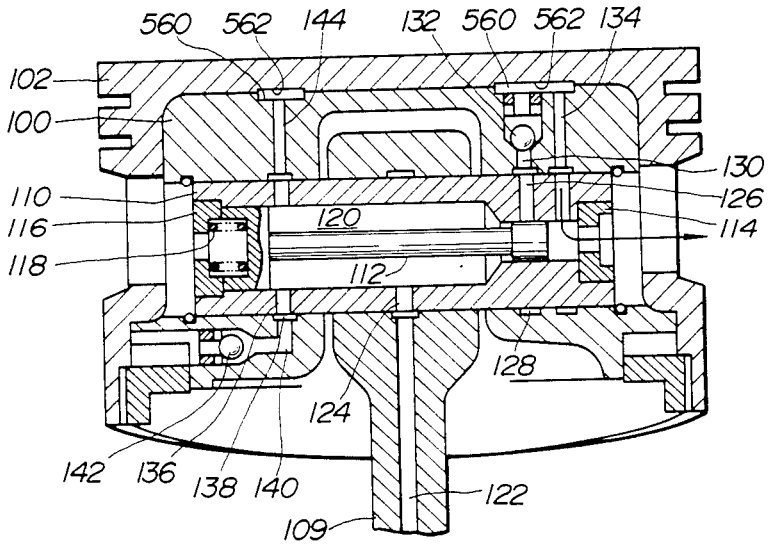

FIGS. 11 and 12 show variants of the third embodiment. In FIG. 11 an annular recess 460 is formed in the inner face of the outer piston 102 in lieu of the crown of the inner piston 100. In the arrangement shown in FIG. 12, mating grooves 560, 562 are formed in both the inner and outer pistons 100, 102.

Figure 13:
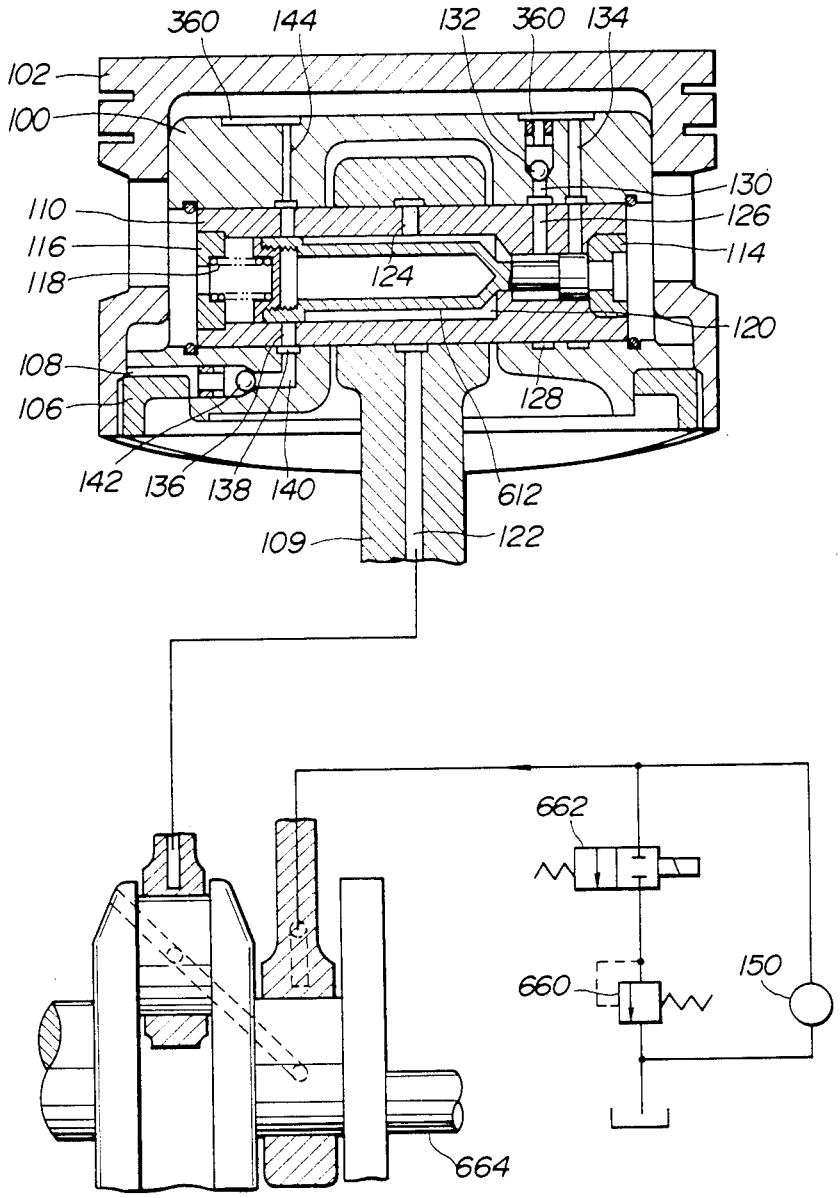
FIGS. 13 and 14 are front sectional elevations showing a sixth embodiment of the present invention conditioned for high and low compression ratio operation respectively.
Figure 14:
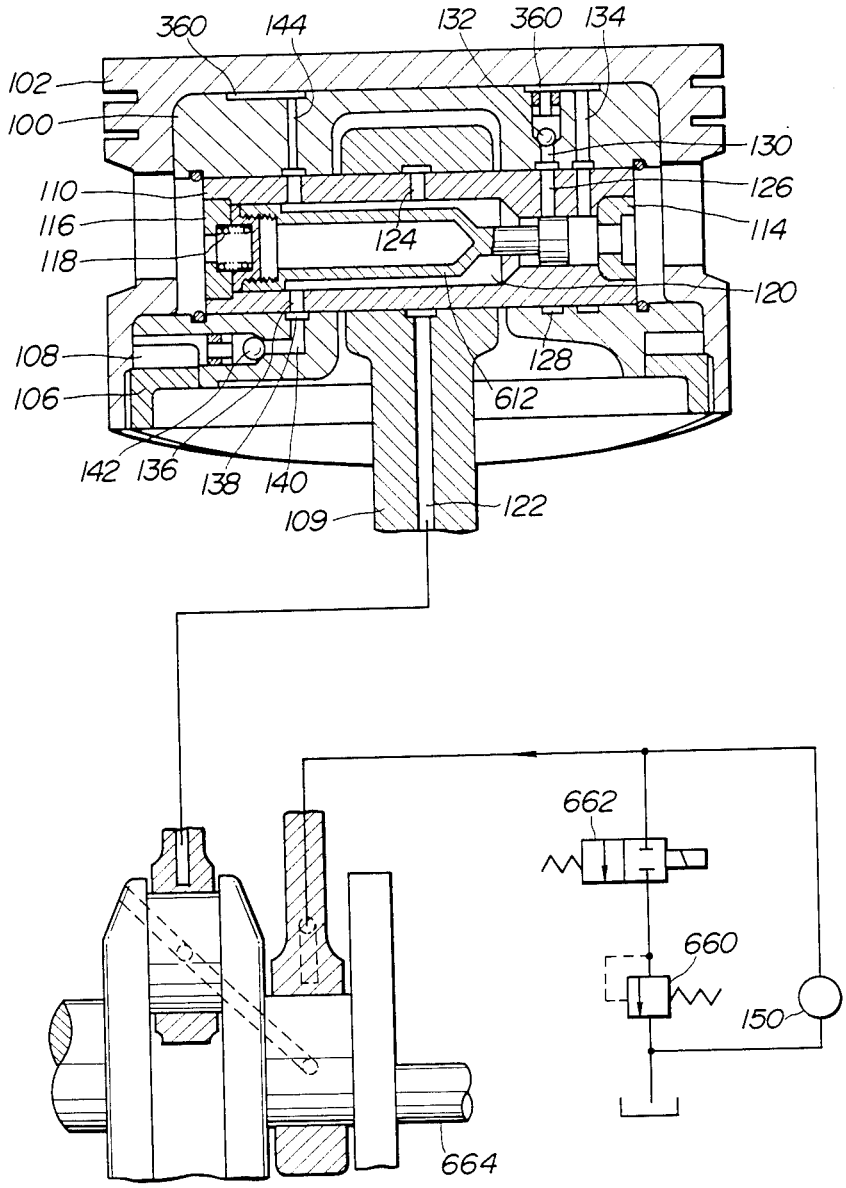

FIGS. 13 and 14 show a sixth embodiment of the present invention. This arrangement is basically identical to the first one but features the arrangement wherein the volume of the cylindrical valve chamber 120 is reduced by increasing the diameter of the shaft section of the spool valve element 612 which extends between the large and small diameter lands thereof. By reducing the volume of the cylindrical valve chamber 120 the response characteristics of the device are improved. Viz., as the hydraulic fluid is not perfectly incompressible a finite time is required to increase the pressure prevailing in the cylindrical valve chamber 120. By reducing the volume thereof and therefore the amount of hydraulic fluid contained therein the time required for the pressure to build to the point of effecting movement of the spool valve element 612 is reduced. In the illustrated embodiment the spool valve element 612 is in part hollow and closed by a recessed cap member (no numeral). This avoids any weight penalties which tend to increase the intertia of the member.

In the sixth embodiment the source of hydraulic fluid under pressure includes a relief valve 660 which is arranged to maintain a first predetermined level of pressure in the cylindrical valve chamber 120 of hydraulic control arrangement. This pressure is selected to the that which will induce high compression ratio operation. A solenoid controlled valve 662 is disposed between the pump 150 discharge port and the relief valve 660. This valve 662 is arranged to assume a first position wherein communication between the pump and the relief valve is permitted when high compression ratio operation is required and a second position wherein the communication is either cut-off or restricted to the point whereat the pressure supplied into the cylindrical valve chamber 120 rises to the level whereat the spool valve element 612 moves to the position shown in FIG. 14 against the bias of the spring 118.

FIGS. 13 and 14 also show a possible passage arrangement via which fluid communication between the source of hydraulic fluid under pressure and the cylindrical chamber can be established via the engine crank shaft 664.

What is claimed is:

1. In an internal combustion engine a cylinder;

a first piston reciprocatively disposed in said cylinder, said first piston having an axial blind bore formed therein;

a second piston reciprocatively disposed in said axial blind bore to define a first variable volume chamber therein;

a retainer for retaining said second piston in said axial blind bore and defining a second annular variable volume chamber between it and said second piston;

a piston pin which operatively interconnects a connecting rod with said second piston;

a source of hydraulic fluid under pressure;

a valve chamber in constant communication with said source;

a supply passage formed in said second piston, said supply passage leading from said valve chamber to said first variable volume chamber;

a drain passage formed in said second piston, said drain passage leading from said first variable volume chamber to a port through which hydraulic fluid can directly drain into said cylinder;

a transfer passage formed in said second piston, said transfer passage leading from said valve chamber to said first variable volume chamber, said transfer passage having a cross section which is smaller than that of said drain passage;

a valve element disposed in said valve chamber, said valve element being responsive to the pressure prevailing in said valve chamber and arranged so that when the pressure in said valve chamber is below a predetermined value, it assumes a first position wherein communication between said chamber and said drain and transfer passages is cut-off and communication between said valve chamber and said supply passage is established, and when the pressure in said valve chamber is above said predetermined value it assumes a second position wherein communication between said valve chamber and said supply passage is cut-off and communication between said drain and transfer passages is established.

2. An internal combustion engine as claimed in claim 1, further comprising a first one-way valve disposed in said supply passage, said first one-way valve being arranged to prevent the flow of hydraulic fluid from said first variable volume chamber back through said supply passage.

3. An internal combustion engine as claimed in claim 1 further comprising:

a communication passage, said communication passage leading from said valve chamber to said second annular variable volume chamber;

a second one-way valve disposed in said communication passage, said second one-way valve being arranged to prevent the flow of hydraulic fluid out of said second annular variable volume chamber.

4. An internal combustion engine as claimed in claim 3 wherein said valve chamber is defined in a stepped bore formed in said piston pin.

5. An internal combustion engine as claimed in claim 3 wherein said valve chamber is defined in a stepped bore formed in said second piston.

6. An internal combustion engine as claimed in claim 1 wherein said valve element takes the form of a spool having a large diameter land and a small diameter land and a shaft section extending therebetween.

7. An internal combustion engine as claimed in claim 1 wherein said source of hydraulic fluid under pressure includes:

a pump;

a pressure control valve associated with said pump for controlling the pressure supplied to said valve chamber; and a control circuit, said control circuit being responsive to a parameter which varies with engine operation and operatively connected with said pressure control valve, said control circuit being arranged to lower the pressure prevailing in said valve chamber to a level which is below said predetermined value when high compression ratio engine operation is required and increase the pressure prevailing in said valve chamber to a level which is higher than said predetermined value when low compression ratio engine operation is required.

8. An internal combustion engine as claimed in claim 6 wherein said the shaft section of said spool which extends between said large and small diameter lands has a displacement which reduces the amount of hydraulic fluid in said valve chamber and increases the response characteristics of the valve to changes in pressure in said valve chamber.

9. An internal combustion engine as claimed in claim 1 further comprising:

a channel formed in one or both of the first and second pistons, said channel providing fluid communication between said transfer passage, said supply passage and said drain passage when said second piston is in abutment with the end of the blind bore formed in said first piston.

10. An internal combustion engine as claimed in claim 1 wherein said first one-way valve takes the form of a valve seat and an unbiased ball valve element, said ball valve element being responsive the flow of hydraulic fluid from said first variable volume chamber back into said supply passage in a manner to seat on said valve seat an cut-off the passage.

11. An internal combustion engine as claimed in claim 3 wherein said second one-way valve takes the form of a valve seat and an unbiased ball valve element, said ball valve element being responsive the flow of hydraulic fluid from said second variable volume chamber back into said communication passage in a manner to seat on said valve seat an cut-off the passage.

* * * * *